US005536228A

United States Patent [19]

Tanner, Jr.

[11] Patent Number: 5,536,228

[45] Date of Patent: Jul. 16, 1996

[54] EXERCISE APPARATUS FOR WHEELCHAIR BOUND PERSONS

[76] Inventor: Ernest L. Tanner, Jr., 1802 Lothrop St., Omaha, Nebr. 68110

[21] Appl. No.: 533,628

[22] Filed: Sep. 25, 1995

[51] Int. Cl.[6] ..... A63B 21/02

[52] U.S. Cl. ..... 482/130; 482/123; 482/121; 482/129

[58] Field of Search ..... 482/121, 122, 482/123, 129, 130

[56] References Cited

U.S. PATENT DOCUMENTS

| | | | |
|---|---|---|---|
| 3,759,512 | 9/1973 | Yount et al. . | |
| 3,910,573 | 10/1975 | Jamba . | |
| 4,153,244 | 5/1979 | Tauber, Jr. . | |
| 4,773,399 | 9/1988 | Richardson . | |
| 4,848,741 | 7/1989 | Hermanson . | |
| 4,911,425 | 3/1990 | Kynast et al. . | |
| 4,911,435 | 3/1990 | Johns . | |
| 5,048,827 | 9/1991 | Caruso . | |
| 5,080,353 | 1/1992 | Tench | 482/130 |
| 5,123,886 | 6/1992 | Cook . | |
| 5,171,295 | 12/1992 | Schwalm, Jr. . | |
| 5,449,336 | 9/1995 | Sabel | 482/130 |

FOREIGN PATENT DOCUMENTS

| | | | |
|---|---|---|---|
| 9220409 | 11/1992 | WIPO | 482/122 |

*Primary Examiner*—Lynne A. Reichard
*Attorney, Agent, or Firm*—Henderson & Sturm

[57] ABSTRACT

A simple, inexpensive exercise apparatus for wheelchair bound persons which allows them to exercise all upper body muscle groups while remaining in their wheelchair. A horizontal platform receives the wheelchair in a forward or rearward orientation, depending on which exercises are to be performed. The wheels of the chair are then locked, and an elastic rope with handles at each end is positioned behind one of several matched pairs of rope guides, situated on a mast, an overhead unit, or on the platform, again depending on the desired exercise. The tension on the rope may be conveniently adjusted by looping it over one of many rope pins, eliminating the need to continually move the wheelchair. The mast and overhead unit may be quickly removed for transportation or storage of the invention.

5 Claims, 5 Drawing Sheets

EXERCISE APPARATUS FOR WHEELCHAIR BOUND PERSONS

TECHNICAL FIELD

This invention relates to exercise equipment, and more particularly to exercise equipment specifically designed for use by a person confined to a wheelchair.

BACKGROUND ART

While exercise equipment for use in schools and health clubs has long been available, more recently there has been much development in the area of home exercise equipment, particularly as an alternative to the use of free weights, which can be dangerous and often require the presence of two people. Unfortunately, most of these systems are only marginally useful for persons confined to a wheelchair. Recently issued U.S. Pat. Nos. 4,911,435 and 5,123,886 disclose exercise equipment designed specifically for wheelchair bound persons, but these devices are extremely complex and expensive. Somewhat simpler devices are disclosed in U.S. Pat. Nos. 4,773,399 and 5,048,827, but these devices are capable of exercising only very limited muscle groups.

DISCLOSURE OF THE INVENTION

The present invention discloses a simple, inexpensive exercise apparatus for wheelchair bound persons which allows them to exercise all upper body muscle groups while remaining in their wheelchair. A horizontal platform receives the wheelchair in a forward or rearward orientation, depending on which exercises are to be performed. The wheels of the chair are then locked, and an elastic rope with handles at each end is positioned behind one of several matched pairs of rope guides, situated on an upright mast, an overhead unit, or on the platform, again depending on the desired exercise. The tension on the rope may be conveniently adjusted by looping it over one of several rope pins, eliminating the need to continually move the wheelchair. The mast and overhead unit may be quickly removed front the platform for ease of transportation or storage of the invention.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
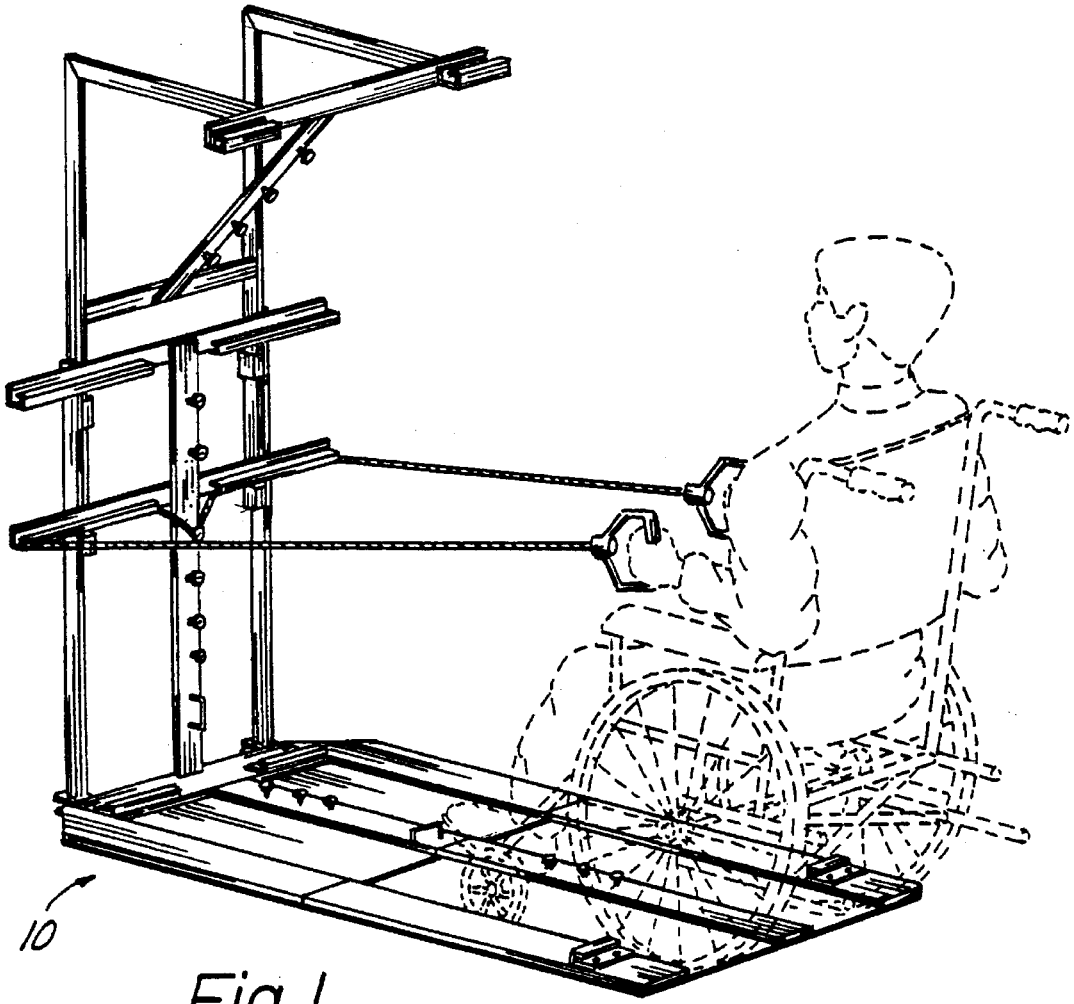
FIG. 1 is a perspective view of the invention from the front.
Figure 2:
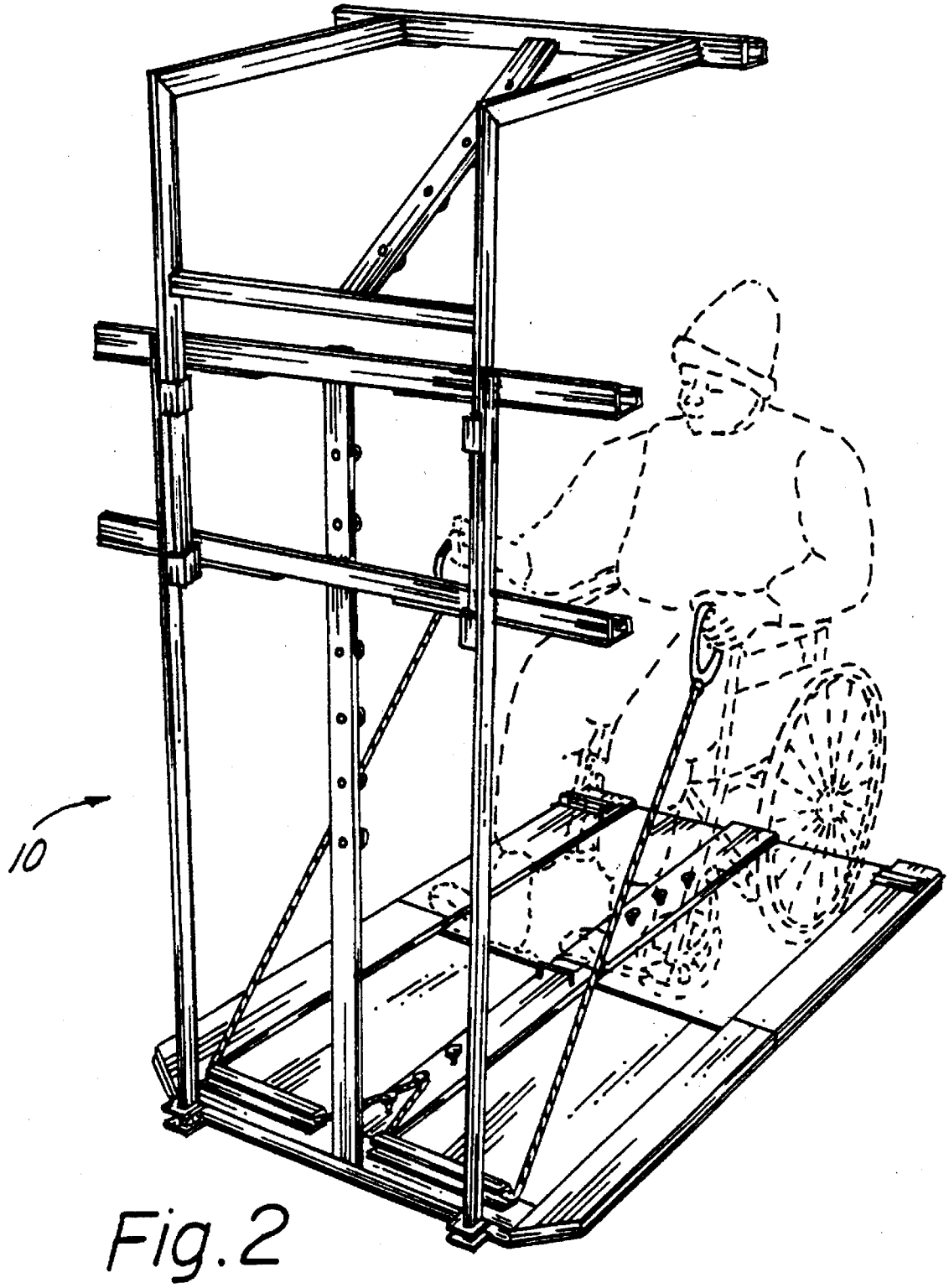
FIG. 2 is a second perspective view of the invention from the rear.

Referring now to the drawings, wherein like reference numerals designate identical or corresponding parts throughout the several views, the invention is identified generally as 10 in FIGS. 1 and 2, with a wheelchair bound person exercising as shown in dashed lines. The invention 10 is designed primarily for use with an elastic exercise rope 12 with a hand grip at each end as shown in FIG. 3.

Figure 3:
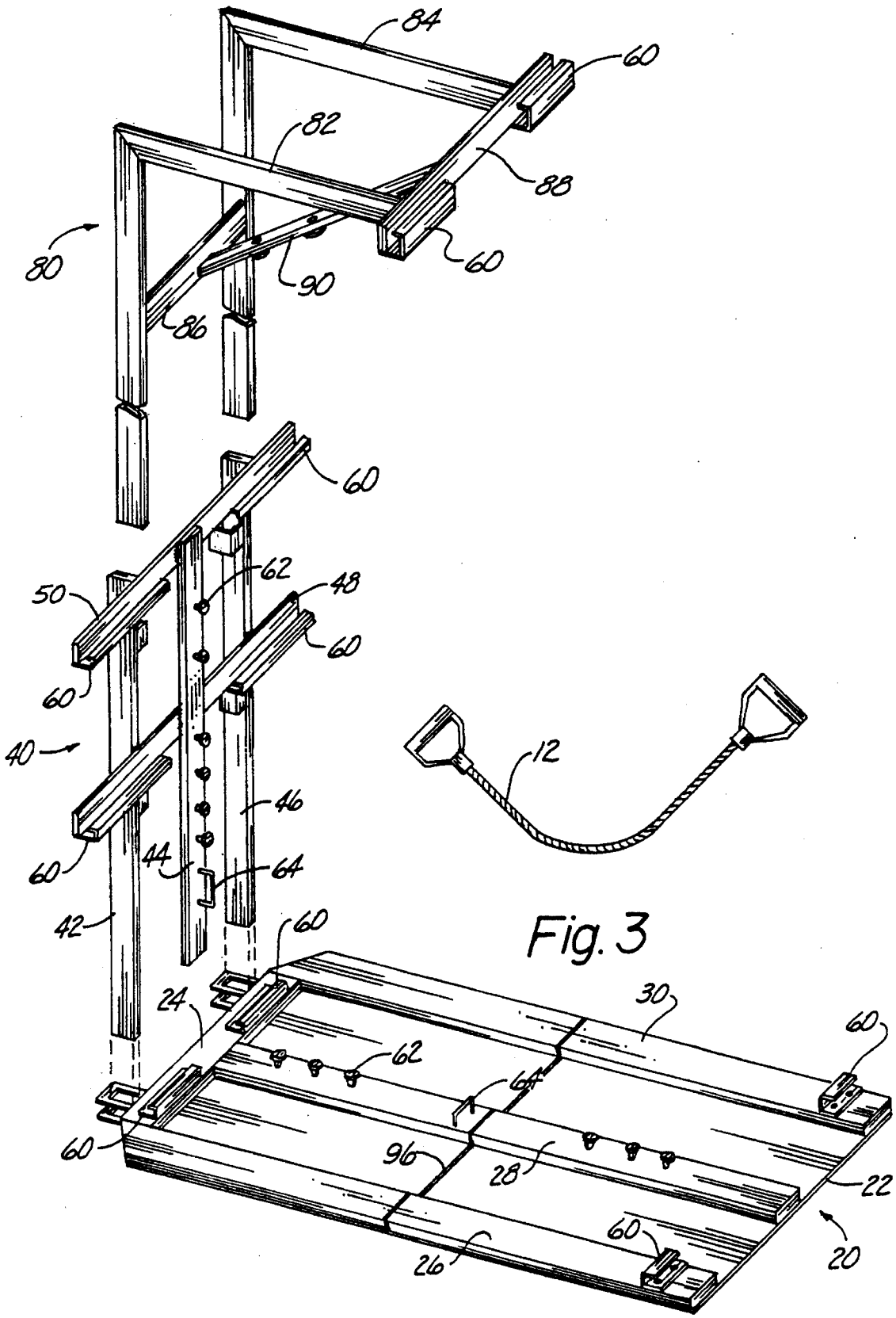
FIG. 3 is a perspective view of the invention with the mast, the overhead unit and the platform separated.

As perhaps best seen in FIG. 3, the invention 10 is comprised of a platform 20 approximately four feet in length, a mast 40 approximately three feet high, and an overhead unit 80 which extends approximately two and one half feet above the mast. The platform 20 is further comprised of a base plate 22, preferably of sheet metal, to which is welded an endbeam 24, and three longitudinal beams 26, 28, 30. The endbeam 24 and longitudinal beams 26, 28, 30 are preferably fabricated from steel box beams approximately 1"×3" in section, and are themselves welded together as depicted. The base plate between the longitudinal beams 26, 28, 30 is preferably covered with rubber matting.

The mast 40 is comprised of three vertical beams 42, 44, 46, to which are welded two horizontal mast crossbeams 48, 50, all of which are fabricated from ½"×1" steel box beams. In the preferred embodiment, the outer vertical beams 42, 46 are turned sideways with respect to the platform for greater strength, whereas the remaining beams 44, 48, 50 face the platform (i.e. their wider surfaces are turned toward the platform). The mast crossbeams 48, 50 are welded to the vertical beams 42, 44, 46 approximately two feet and three feet above the platform 20.

Figure 4:
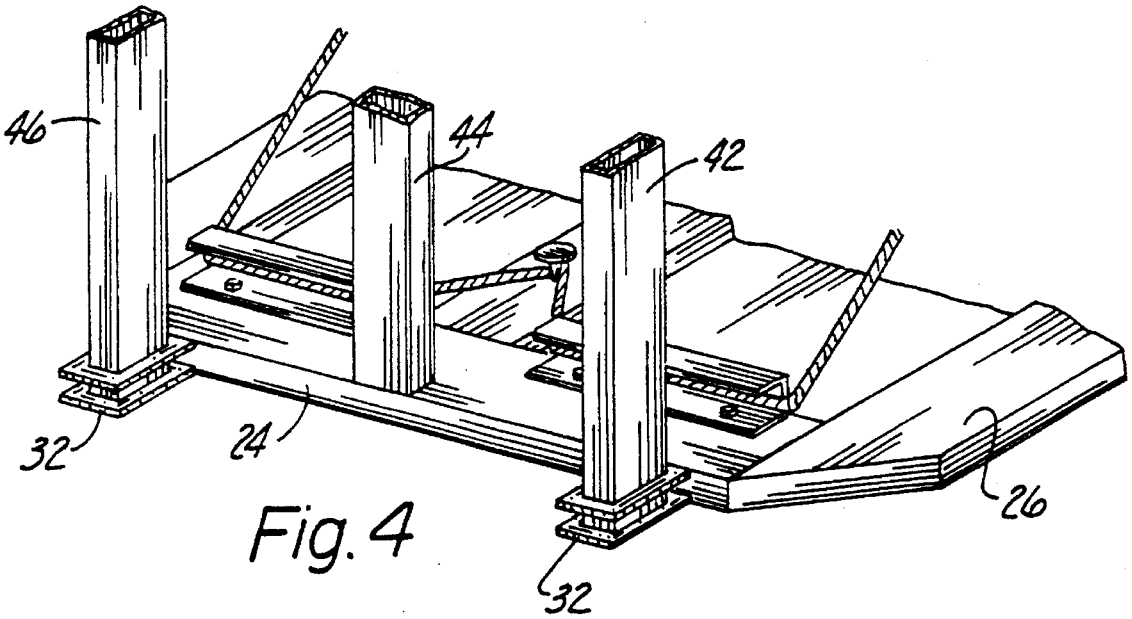
FIG. 4 is a rear close-up view of the mast inserted into the support brackets of the platform.
Figure 5:
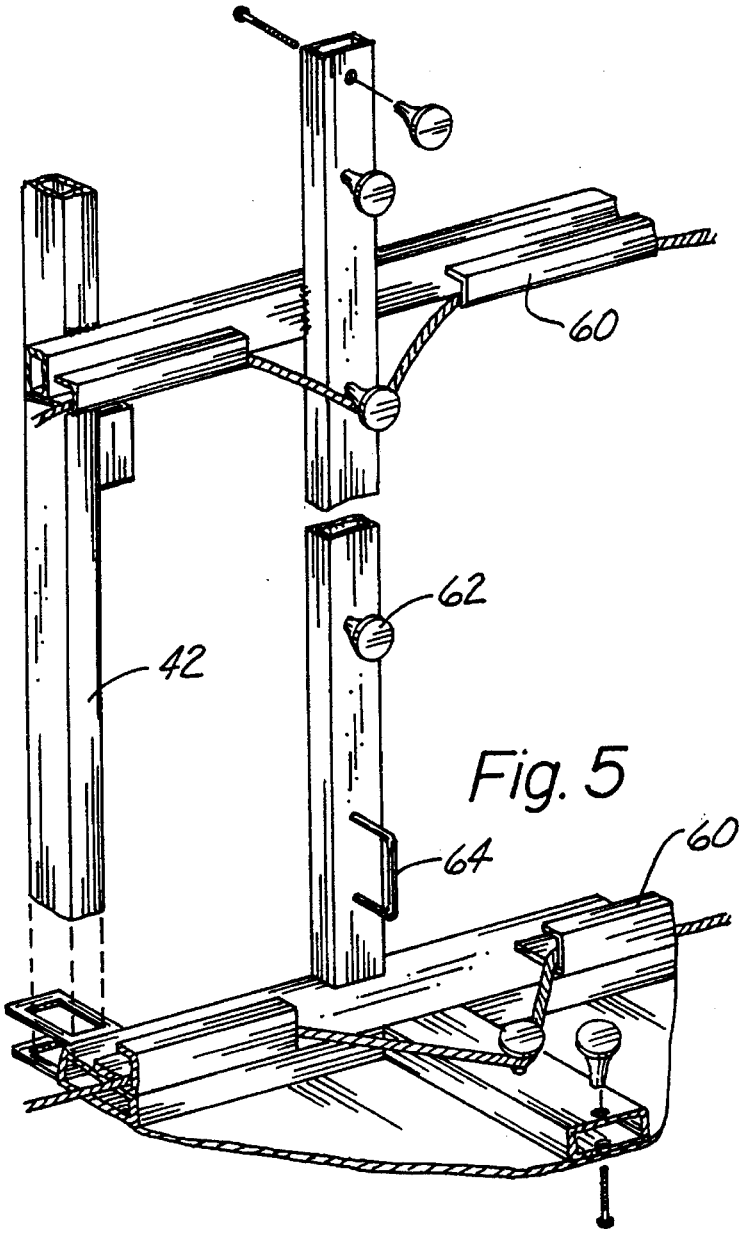
FIG. 5 is a front close-up view depicting the securement of the mast to the platform.
Figure 6:
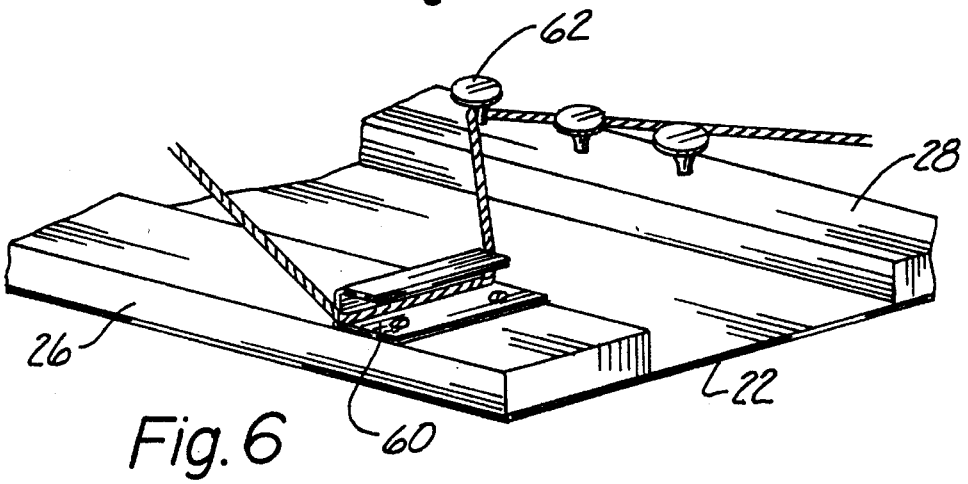
FIG. 6 depicts a typical routing of the elastic rope around a rope guide and a rope pin.

As seen in FIGS. 3, 4 and 5, the mast 40 is removably secured to the platform 20 by means of U-shaped brackets 32 which have been welded to the rearward end of the endbeam 24. The outer vertical beams 42, 46 slide down into the brackets 32 while the central vertical beam 44 rests atop the endbeam 24.

Figure 7:
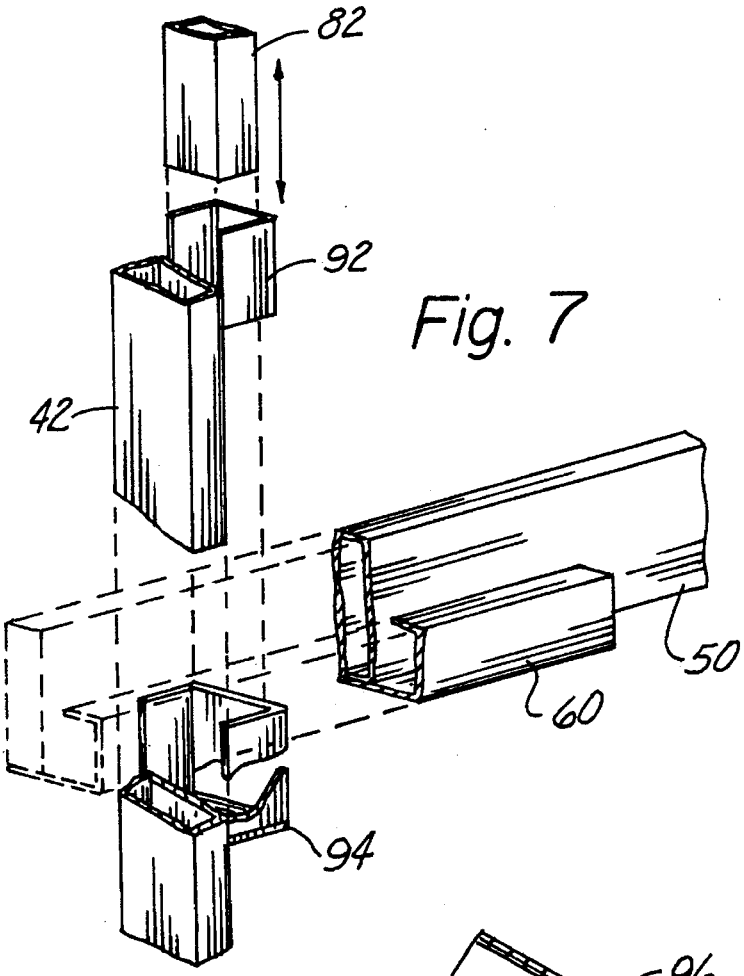
FIG. 7 depicts the insertion of the overhead unit into the mast.
Figure 8:
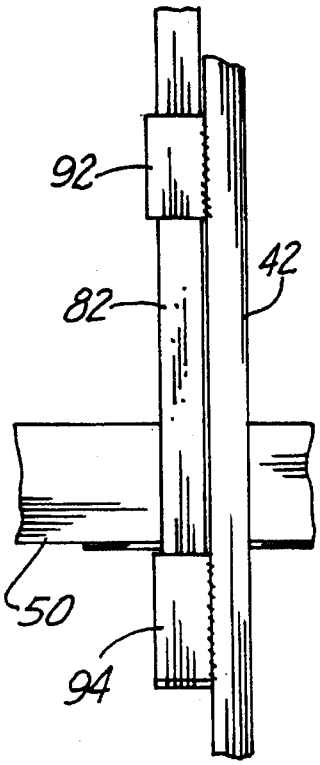
FIG. 8 is a rear view showing the securement of the overhead unit to the mast.

The overhead unit 80 is comprised of two L-shaped members 82, 84, held in a spaced apart relationship by two overhead crossbeams 86, 88, and further strengthened by an angled support beam 90 extending between the two overhead crossbeams 86, 88. As shown in FIGS. 7 and 8, the overhead unit 80 is removably secured to the mast 40 by means of a pair of U-shaped brackets 92 and U-shaped cups 94 which receive the lower ends of the L-shaped members 82, 84.

To each end of the mast crossbeams 48, 50, and overhead crossbeam 88 is secured a U-shaped rope guide 60 by means of welding or machine screws. There is also a pair of rope guides 60 secured to the endbeam 24 and to the forward ends of the outer longitudinal beams 26, 30. Several rope pins 62 are secured along the central vertical beam 44, the central longitudinal beam 28, and the angled support beam 90, preferably by countersunk bolts extending through the respective beams into the pins 62. The central vertical beam 44 and the central longitudinal beam 28 also each carry a U-bolt 64 through which the elastic rope 12 may be inserted and looped over a rope pin 62 for additional exercises.

The different arrangements and combinations of rope guides 60, U-bolts 64, and rope pins 62 provide a great number of different exercises for different muscle groups and permit simple adjustment of tension on the elastic exercise rope 12. Of course, the wheelchair can be backed onto the platform for further types of exercises.

Figure 9:
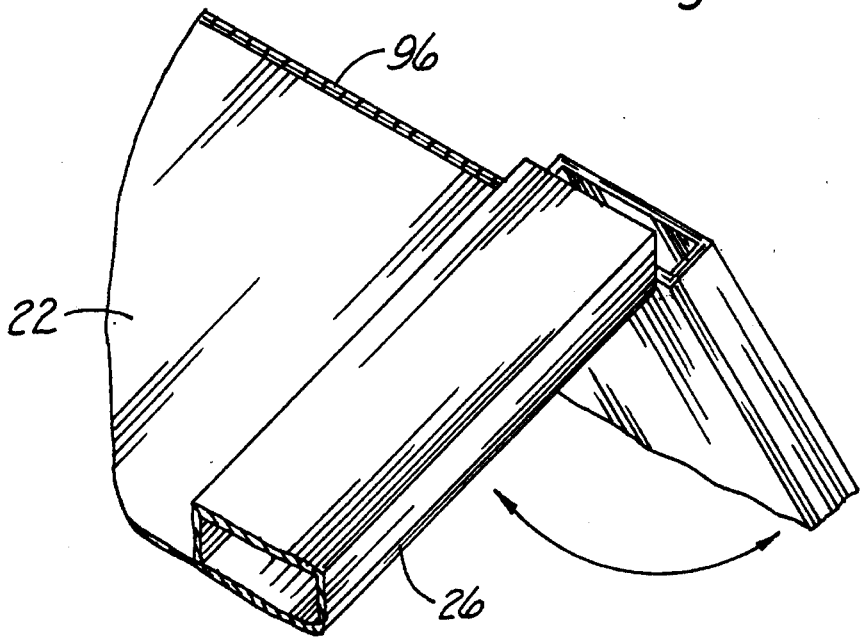
FIG. 9 depicts the folding of the platform for transportation.

As shown in FIG. 9, in the preferred embodiment of the invention the platform 20 is actually two separate sections held together by a piano hinge 96 which is secured to the base plate 22. Each of the longitudinal beams 26, 28, 30 is cut approximately in half to allow the platform 20 to be folded in half to facilitate transportation of the invention. For transportation, the platform U-bolt 64 may serve as a carrying handle.

Obviously, many modifications and variations of the present invention are possible in light of the above teachings. It is therefore to be understood that, within the scope of the appended claims, the invention may be practiced otherwise than as specifically described for the best mode.

What is claimed is:

1. An exercise apparatus for wheelchair bound persons, comprising:

an elastic exercise rope;

a platform including a base plate having an endbeam and a central and two outer longitudinal beams affixed thereto in a parallel, spaced apart relationship perpendicular to said endbeam;

a mast, secured to said endbeam and extending upward therefrom, including a vertical beam having a mast crossbeam affixed thereto;

a plurality of rope pins secured at spaced apart positions along said central longitudinal beam and along said vertical beam; and a plurality of rope guides secured to said mast crossbeam, to said endbeam, and to said outer longitudinal beams.

2. The exercise apparatus as recited in claim 1 wherein said mast is comprised of two outer beams and a central beam.

3. The exercise apparatus as recited in claim 2 wherein said two outer beams are each removably received within a U-shaped bracket extending from said crossbeam.

4. The exercise apparatus as recited in claim 1, further comprising an overhead unit having a pair of rope guides and a plurality of rope pins affixed thereto.

5. The exercise apparatus as recited in claim 4 wherein said overhead unit is removably secured to said mast.

* * * * *